US006955271B1

(12) United States Patent
Stallings

(10) Patent No.: US 6,955,271 B1
(45) Date of Patent: Oct. 18, 2005

(54) SERVER STORAGE UNIT

(76) Inventor: Michael Stallings, 2090 Brys Dr., Grosse Pointe, MI (US) 48236-1072

( * ) Notice: Subject to any disclaimer, the term of this patent is extended or adjusted under 35 U.S.C. 154(b) by 0 days.

(21) Appl. No.: 10/855,158

(22) Filed: May 27, 2004

(51) Int. Cl.[7] ..... A47F 5/02
(52) U.S. Cl. ..... 211/144
(58) Field of Search ..... 211/144, 131.1, 211/163, 134, 133.1, 151, 150, 165, 4

(56) References Cited

U.S. PATENT DOCUMENTS

| | | | | |
|---|---|---|---|---|
| 860,658 | A * | 7/1907 | Hawthorne et al. | 312/123 |
| 2,344,650 | A * | 3/1944 | Sloat | 211/78 |
| 2,511,715 | A * | 6/1950 | Kappel | 211/78 |
| 4,531,645 | A * | 7/1985 | Tisbo et al. | 211/131.1 |
| 4,774,631 | A | 9/1988 | Okuyama et al. | |
| 5,216,579 | A | 6/1993 | Basara et al. | |
| 5,452,951 | A | 9/1995 | Peller | |
| 5,536,079 | A | 7/1996 | Kostic | |
| 5,798,485 | A | 8/1998 | Rohde et al. | |
| 5,901,033 | A | 5/1999 | Crawford et al. | |
| 6,016,927 | A * | 1/2000 | Krupp | 211/126.2 |
| 6,185,098 | B1 | 2/2001 | Benavides | |

* cited by examiner

*Primary Examiner*—Sarah Purol
(74) *Attorney, Agent, or Firm*—Young & Basile, P.C.

(57) ABSTRACT

A rack system including a rectilinear frame, at lease one shelf positioned in the rectilinear frame; and a base unit in contact with the rectilinear frame, the base unit and associated rectilinear frame rotatable round a suitable central pivot point.

9 Claims, 3 Drawing Sheets

SERVER STORAGE UNIT

FIELD OF THE INVENTION

The present invention relates generally to racks, shelving and cabinets for mounting and storing electronic components such as file servers and associated equipment. More particularly, the present invention relates to shelving systems having a plurality of vertically arrayed compartments for mounting and storing electronic components. Even more particularly, the present invention relates to shelving systems for file servers having rotatable and/or movable features.

BACKGROUND OF THE INVENTION

Frames and cabinets for mounting and storing electronic components have been known for many years. Frames are typically simple rectangular frameworks on which electronic components such as file servers can be mounted, or on which other mounting members, such as shelves or brackets may be affixed to support the desired electronic components.

Frames have been built in many different sizes and with many different proportions in order to best accommodate the server components they are designed to store. Large frames have been created to hold large components or to hold multiple components. Smaller frames and cabinets are more commonly utilized for smaller components.

Typically, larger traditional computer installations are contained entirely within one room in a building. The installation facility, which commonly includes the room and everything in it, is typically under the control of a single entity, who oversees such operational details as the design of the installation, the physical installment process, the day-to-day operation of the installation, service and maintenance for the computers in the installation, the environmental characteristics of the room, security for the room and many other details. Thus, the single entity has the ability and authority to install and arrange frames at the installation facility however desired. In such situations, the electronic devices are arranged on appropriate frames or shelf units however desired. Typically the arrangement of the electronic devices is accomplished in a way that minimizes the number of frames by utilizing the largest size frame that will fit within the room and by installing as many components within each frame as feasible. The number of frames installable in a single room or location is limited by certain factors. One of these factors is the necessity to be able to access the electronic components for service, maintenance and the like. Many times, access means that the rear portion of the server or other electronic component must be reached in order to service the unit. In order to accomplish this, the storage frames need to be positioned so as to be freestanding from the wall to permit ready access to the rear of the various components. This means that a great deal of floor space must be wasted in order to provide such access. Where there are multiple servers, it is desirable to conserve floor space.

With the advent of the Internet and various intranet applications, a different type of server installation facility has also developed. The operation of the internet requires the joint efforts of thousands or tens of thousands of specialized computers commonly known as servers. Servers are used to communicate data from one point to another in the world-wide web. Additionally, various servers have been developed which facilitate "Intranet" communications for a business entity, information system or the like. In order to facilitate computer operations either utilizing the internet and/or the intranet systems, the servers are typically stationed in multiple different locations, generally proximate to a business or system user. This requires thousands of installation facilities. It can be appreciated that each installation facility requires a certain amount of space, staff personnel to oversee operation, sufficient environmental controls including sufficient heating and air conditioning equipment as well as other necessities. In many instances such space is at a premium. Thus it would be desirable to be able to position servers and the associated electronic equipment in a small convenient location that could be readily accessed for repair and/or maintenance. It is also desirable to provide storage racks or units that are stable, and secure and provide for the organized stable positioning of the servers and various associated electronic components. Once again, it can be appreciated that minimization of floor space required for location of the various servers is desirable. However, it is also desirable that all servers be positioned in a structurally secure manner which permits access to the front, back or sides of a server to facilitate upkeep and maintenance.

SUMMARY OF THE INVENTION

As disclosed herein, there is provided a rack system for housing electronic equipment such as file servers and related devices composed of a frame and a base unit rotatable round a suitable central pivot point. The frame includes upper and lower horizontal frame members connected to a plurality of vertical support members. The base includes a support member in contact with the lower horizontal frame member. A plurality of wheel members are attached to the support member. Also attached to the support member is a central pivot mechanism positioned to provide rotational movement around a central fixed point. The wheels and pivot member are positioned on a lower platform such that the rack may rotate around a fixed point defined in the center of the lower platform.

The frame also includes a plurality of shelves connected to and positioned vertically in relation to frame. One or more shelves may telescopically protrude outward from the central region defined by the frame.

BRIEF DESCRIPTION OF THE INVENTION

For a more complete understanding of the present invention and the advantages thereof, reference is now made to the following description taken in conjunction with the accompanying drawings, wherein like reference numerals represent like parts, in which.

DESCRIPTION OF THE PREFERRED INVENTION

Disclosed herein is a rack system for mounting and maintaining electronic components such as file serves and associated hardware. The rack system includes a frame composed of upper and lower horizontal frame elements and a plurality of vertical frame members connected thereto. The upper and lower horizontal frame elements and associated vertical frame members are connected to form a rectilinear frame member that is rotatable mounted to a suitable base.

Figure 1:
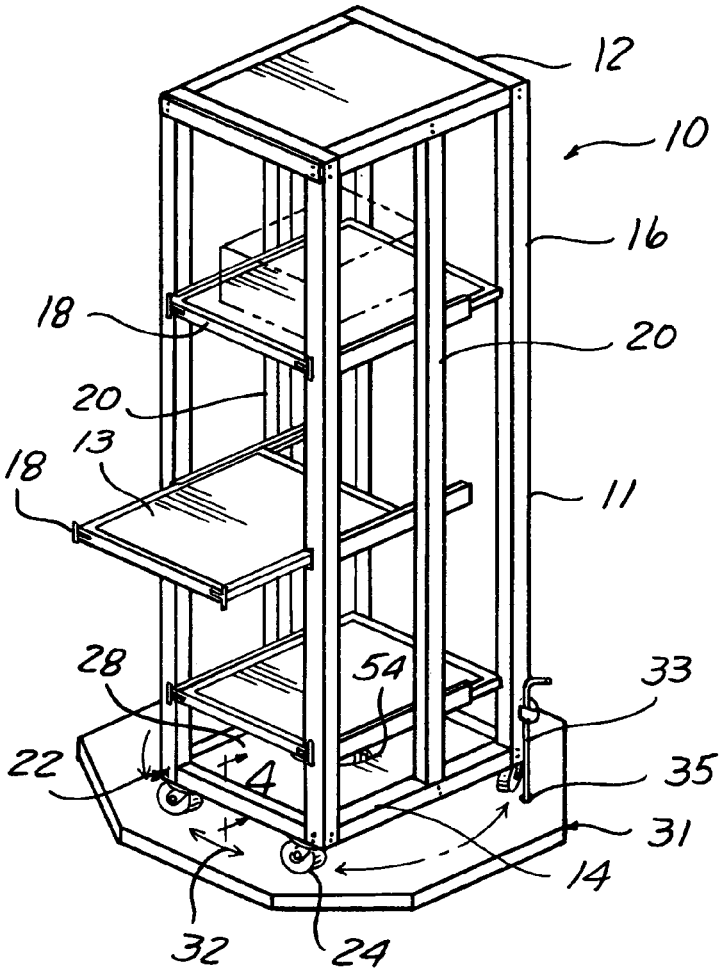
FIG. 1 illustrates a perspective view of a rack system according to an embodiment disclosed herein.

As illustrated in FIG. 1, the rack system 10 includes appropriate devices for permitting rotatable movement such as a suitable support base having plurality of wheels or casters positioned peripheral to a suitable pivot mechanism.

As depicted in FIG. 1, a first embodiment of the rack system 10 includes a suitable frame 11. The frame 11 may have any suitable configuration that will permit positioning and storage of file servers and associated equipment. As depicted in FIG. 1, the frame 11 is a rectilinear construction. As employed herein the term rectilinear is taken to include essentially square constructions as well as constructions that have more elongated rectangular configurations. It is also considered within the purview of this invention that the frame 11 be configured with plurality of rectangular regions of varying size provided that the ultimate construction exhibits suitable structural and positional stability. However, it is also believed that the rectilinear configuration as depicted in FIG. 1 will exhibit advantages in many situations.

The frame 11 as depicted in FIG. 1, includes an upper frame member 12 and a a lower frame member 14. The upper and lower frame members 12, 14 are positioned essentially horizontal in an orientation essentially parallel to the floor on which the rack system 10 is positioned. The upper and lower support members 12, 14 are connected to one another by a plurality of vertical support members 16.

As depicted in FIG. 1, the upper frame member 12 and lower frame member 14 have a suitably square configuration. The plurality of vertical support members 16 may have a length greater than the width defined by the upper and lower frame members 12, 14. The number of vertical support members 16 can be that suitable for maintaining the integrity and structure of the frame 11 of rack system 10. As depicted in FIG. 1, vertical support members 16 are positioned proximate to each corner of the respective upper and lower horizontal frame members 12, 14. The vertical support members 16 can be attached to the upper and lower frame members 12, 14. The vertical support members 16 can be attached to the upper and lower frame members 12, 14 by any suitable means. Non-limiting examples of attachment include mechanical fastening as by bolts and he like as well as by welding or other means.

Where desired or required, the frame can include additional structural support. It is contemplated that such additional support can include additional vertical support members 20. As depicted in FIG. 1 the additional vertical support members 20 are located on at least two opposing vertical sides of the frame 11 and are positioned between two respective vertical supports 16. The additional vertical support members 20 can be included to provide additional mounting/attachment surfaces for various shelves such as shelves 18.

The frame 11 of rack system 10 includes a plurality of shelves 18 disposed at appropriate positions in the rectilinear frame 11 as defined by vertical support members 16 and upper and lower support members 12, 14. The frame 11 may include any number of shelves 18 as desired or required. The number of shelves 18 and vertical spacing between the respective shelves will be determined by the end use application of the associated rack system 10. As depicted in the embodiment in FIG. 1, the rack 10 includes three shelves 18. However additional shelves are contemplated as being within the purview of the present invention.

The shelves 18 can be permanently fixed to the frame 11 of the rack system 10. "Permanent fixture" as the term is used herein can include fixture relative to the vertical orientation of the shelf 18 relative to the frame 11. The permanently fixed shelf 18 may be configured to permit lateral movement of a central shelf surface 13 in telescopic relationship to the interior of the frame 11 of rack system 10. The shelf surface 13 (and any server or associated piece of electronic equipment such a keyboard or the like) can be retractable extended outwardly of the frame 11. Such telescopic outward movement of shelf surface 13 as depicted in FIG. 1 can be advantageously used to permit access to servers or other associated electronic equipment positioned on the respective shelves 18.

It is also contemplated that one or more of the shelves 18 may be permanently fixed within the frame 11. Where fixed shelves are utilized, it is contemplated that the fixed shelf can be fixed and attached within the frame 11 in a manner that provides structural stability to the frame 11 and associated rack system 10

The rack system 10 also includes a suitable base unit 22 configured to support and position frame 11 thereon. As depicted in FIG. 1, the base unit 22 is positioned in underlying relationship to lower frame member 14 such that lower frame member 14 is supported by base unit 22.

Figure 2:
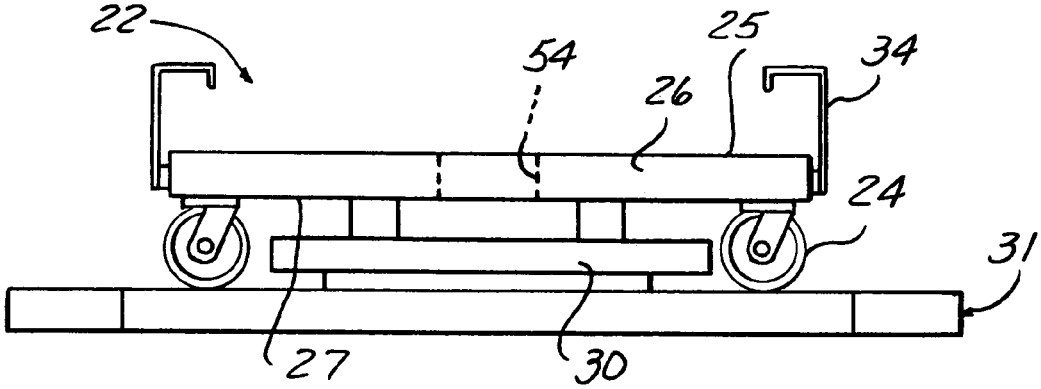
FIG. 2 illustrates a side view of the base unit and associated mounting base support member according to the embodiment as disclosed in FIG. 1.

As depicted in FIG. 2, he base unit 22 includes a horizontal support member 26 having an upper face 25 and an opposed lower face 27. The at least a portion of the upper face 25 of the horizontal support member 26 is configured to be in lateral contact with the lower frame member 14. The horizontal support member 26 is configured to permit rotational movement of the associated frame 11 of rack system 10 about a suitable pivot point.

The base unit 22 also includes a suitable device for facilitating rotational movement of the associated frame 11. Non-limiting examples of a suitable device can be any friction reducing mechanism such as casters, wheels or the like. As depicted in FIG. 2, a plurality of wheel members 24 are attached to the lower face 27 of the horizontal support member 26 proximate to the outer periphery of the horizontal support member 26. It is contemplated that the wheels 24 can be mounted by any suitable mounting bracket. If desired or required, the wheels can include an appropriate individual pivot element (not shown).

Figure 3:
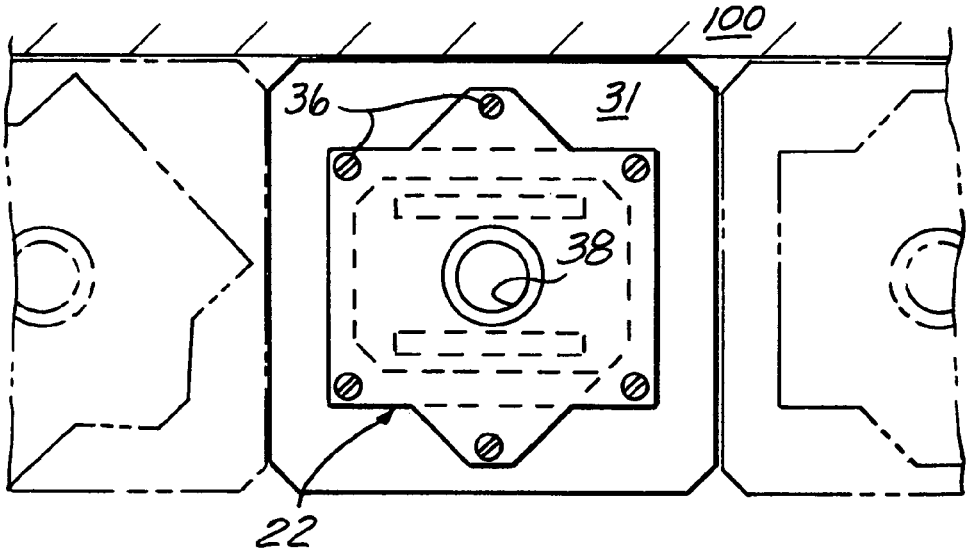
FIG. 3 is a top view of a base unit according to an alternate embodiment as disclosed herein.

The rack system 10 can include any number of wheels 24 necessary to achieve stable rotational movement. As depicted in FIGS. 1 and 2, the rack system 10 utilizes four wheels positioned proximate to the four corners of the frame 11. In alternate embodiments, it is contemplated that greater numbers of wheels 24 or other rotational facilitation devices may be employed. By way of non-limiting example, the base can include six wheels mounted to the horizontal support member 26 as depicted in FIG. 3. The wheels can be mounted by any suitable device. As depicted in FIG. 3, it is contemplated that each respective wheel 24 is mounted by a suitable bolt or screw 36.

The base 22 of rack system 10 also includes a suitable central pivot mechanism 30. The pivot mechanism 30 also permits moveable rotation of the base 22 and associated frame 11 in the directions depicted by arrows 32. The base 22 of rack system 10 can also include suitable locking clamps 34 configured to engage the outer surfaces of lower frame member 14 and maintain integral contact between the respective elements. It is contemplated that the locking clamps are mounted to the base 22. As depicted in FIG. 2, the clamps 34 can have a suitable configuration such as a "C" shaped to engage the lower frame member 14 and maintain it in secure relationship with the base 22.

The rack system 10 as depicted herein also includes a suitable support platform 31. The support platform 31 has a lower face adapted to be positioned on a suitable external support substrate such as a floor or the like. The support platform 31 also has an opposed upper essentially planar surface adapted to support wheels 24. The support platform 31 can be constructed or any suitable material. Where desired or required, the material of choice may have insulative characteristics to minimize undesired electrical conductivity between the floor or substrate and the frame 11 and support 31.

The frame 11 can be constructed of any suitable material. Materials of choice are those that combine low cost with strength and structural durability. Various metals and metal alloys can be advantageously employed.

Figure 4:
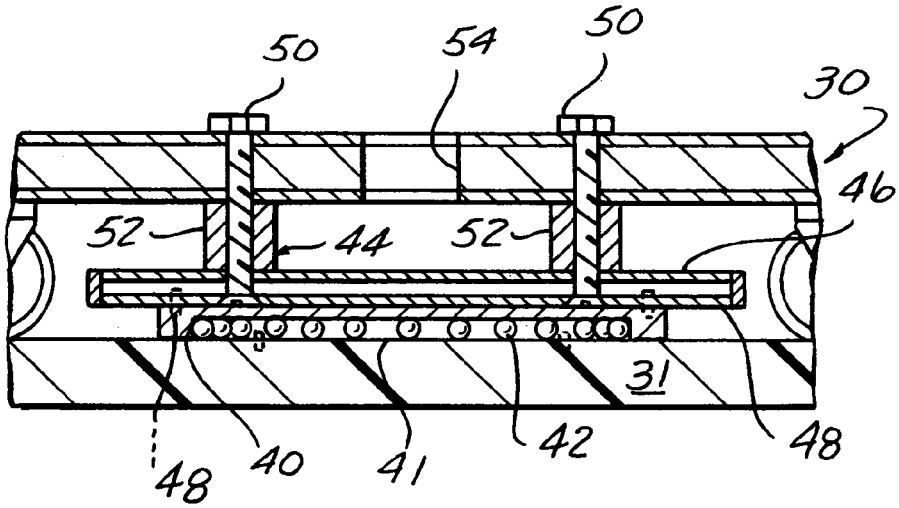
FIG. 4 is a cross-sectional view taken through the 4—4 line of FIG. 1.

The base 22 may be composed of suitable metals, metal matrix composites, polymers, and the like. Similarly shelves may be constructed of suitable materials. The pivot mechanism 30 can be configured to provide central pivotal relationship between the frame 11 and the upper planer surface of the support platform 31. As depicted in FIG. 3, the pivot mechanism 30 includes a suitable circular bearing 38 centrally positioned for rotational ease. The circular bearing 38 is defined in the upper surface of the support platform 31. As depicted in FIG. 4, a ball bearing portion or race 41 containing a plurality of ball bearings 42 is defined in a housing 40 located on the upper surface of support platform 31. It is also contemplated that the race 41 and suitable housing 40 may be positioned in a suitable detente (not shown) defined in the support platform 31 if desired or required.

As depicted in FIGS. 2 and 4, the pivot 30 also includes a connector for affixing a shelf platform 28 and associated lower horizontal frame 14 to the pivot 30. Connector 44 as depicted includes intermediate plate 46 mounted to the pivot housing 40 by a suitable attachment mechanism such as lag nut 48. Suitable lag screws 50 are extended through shelf platform 28 into contact with the intermediate plate 46. As depicted in FIG. 4, lag screws 50 also extend through risers 52. Risers 52 can have any suitable height to provide clearance between the lower face of the lower frame member 14 and the support platform 31 sufficient for wheel movement. The riser size will be one which permits the wheels to fit, locks the lower frame member 14 and associated shelf platform 28 to the intermediate plate 46 in such a way as to provide little load bearing function directed to pivot mechanism 30. It is contemplated that the load exerted by the frame 11 and the equipment placed thereon is directed through the wheels 24 to support platform 31. It is contemplated that the orientation of the pivot mechanism with respect to the base shelf 28 and associated lower frame member 14 maintains the base 22 and frame 11 in position with respect to the support platform 31 such that the base 22 and frame 11 sustain rotational movement with little or no lateral movement relative to the support base.

Where desired or required, support shelf 28 and associated support member 26 in base unit 22 can be configured with a suitable central apertures 54 of a suitable size to permit access and transfer of suitable wires or cables there through.

The rack system 10 can also include a suitable device for anchoring the frame 11 relative to support platform 31 in order to arrest rotation of frame 11 relative to support platform 31. As depicted in FIG. 1, suitable anchoring device 33 includes at least one slide bar 35 telescopically mounted to the frame 11 and removably insertable in a suitable aperture 35 defined in the upper face of support platform 31. Insertion of the slide bar 33 into aperture 35 positions or anchors the frame 11 and support base 22 against additional rotational movement. If desired, the support platform 31 can include additional apertures (not shown) to lock the frame 11 and base 22 in various rotational locations.

It is contemplated that the rack system 10 can have any suitable number of shelves 18 as desired or required. As depicted in FIG. 1, the rack 10 includes three shelves 18. The lowermost shelf 18 is positioned in relative near proximity to the base support shelf 28. It is contemplated that the space defined by the base support shelf 28 and the lowermost shelf 18 will be one sufficient to removably receive heavy items such as uninterruptible power supplies (UPS) and the like. The remaining shelves 18 can be positioned using any suitable spacing to facilitate holding the appropriate file servers and related paraphernalia. While it is not shown, it is contemplated that various shelves can be located to optimally position the servers and associated equipment. Thus, while FIG. 1 depicts moveable shelves 18 at essentially equidistant spacing in the rack system 10, it is also contemplated that a shelf 18 may be positioned proximate to an additional shelf to facilitate positioning a keyboard or other input device for use by maintenance personnel, information technology personnel and the like. While the shelves 18 as depicted in FIG. 1 are each depicted as telescope or drawer-like shelves, it is also contemplated that the rack system 10 can include at least one fixed shelf (not shown) to contribute to stability of the rack system 10.

Figure 5:
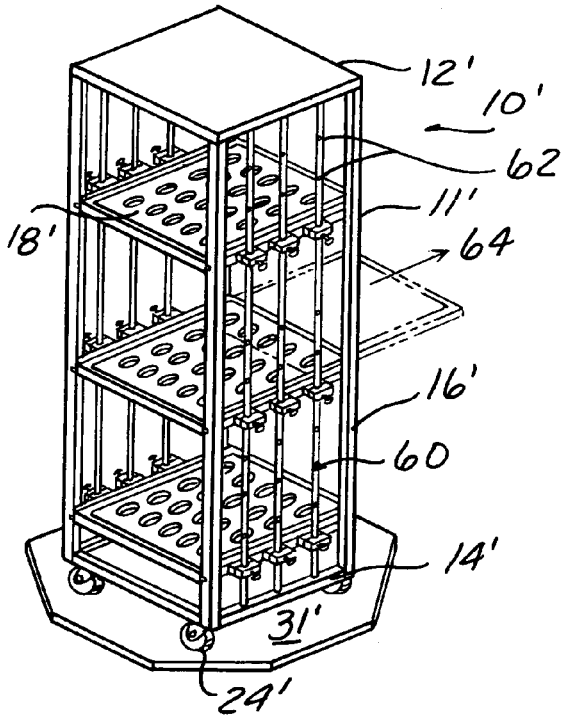
FIG. 5 is a perspective view of an alternate embodiment of the rack system disclosed herein.
Figure 7:
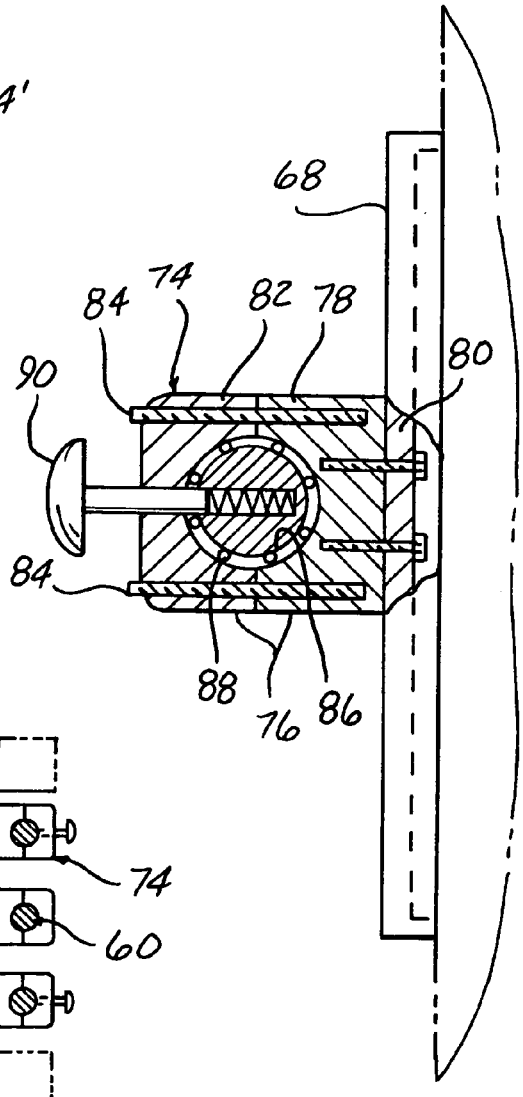
FIG. 7 is a detailed cross-sectional view of a vertical adjustment member as depicted in the alternate embodiment of FIG. 5.
Figure 6:
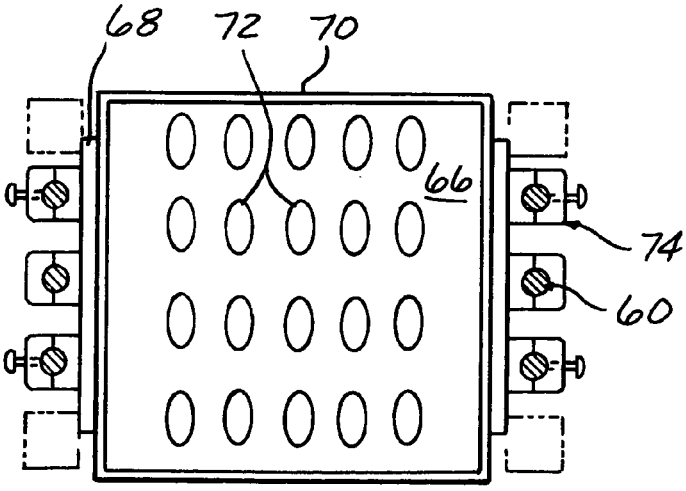
FIG. 6 is a top view of a shelf of the rack system according to the alternate embodiment as depicted in FIG. 5.

An alternate embodiment of the device as disclosed herein is depicted in FIGS. 5, 6 and 7. Turning first to FIG. 5, there is depicted a rack system 10' having a frame 11' defined by upper and lower horizontal frame members 12', 14' and appropriate vertical supports 16'. The frame 11' as depicted in FIG. 5 includes a plurality of vertical bearing rods 60 extending from the upper frame member 12' to the lower frame member 14' and positioned in fixed relationship relative thereto. The vertical bearing rods 60 include a plurality of apertures 62 positioned in spaced relationship on vertical bearing rods 60. The frame 11' includes a plurality of shelves 18'. It is contemplated that one or more of the shelves can be adapted to telescopically move outward from the frame as in arrow 64.

The shelves 18' include a flat central support surface 66 mounted in a suitable slide elements 68 as by frame 70. The flat central support surface 66 can be configured with a plurality of apertures 72 positioned to permit and promote airflow through the rack 10'. It is contemplated that the shelves 18' can be moveable in a vertical orientation within the frame 11' of rack system 10'.

Movement of the shelves 18' in a vertical direction can be accomplished by any suitable mechanism. As depicted in the drawing FIGS. 5, 6 and 7, it is contemplated that shelf 18' includes a plurality of bearing assemblies 74 adapted to surround and removably engage vertical bearing rods 60.

The vertical bearing assembly 74 may be configured in any suitable manner. As depicted in FIG. 7, vertical bearing assembly 74 includes a suitable block 76 having an interior portion 78 adapted to be fastened to the shelf slide 68 as by suitable bolts 80. The block 76 also includes an outwardly positioned portion 82 fastened to interior portion 78 by means of a suitable bolts or other fastening means. Taken together, the block defines a suitable throughbore 86 adapted to receive vertical bearing rod 60. The throughbore 86 is configured with appropriate bearing members such as ball bearings 88 to permit movement of the vertical bearing assembly 74 and associated shelves 18' relative to the vertical bearing rods 60.

Once the shelf 18' is in appropriate position, the shelf 18' can be positioned by the insertion of a suitable pull pin 90 located in the block 76 into aperture 62 in the associated bearing rod 60. As depicted in FIGS. 5, 6 and 7, the rack system 10' is configured with a plurality of bearing robs 60 and vertical bearing assemblies 74 positioned on opposite sides of the frame 11'. Removal of the respective pins from engagement with the associated aperture 62 in the bearing rod 60 permits vertical adjustment of the associated shelf 18'. The use of a plurality of the vertical bearing assemblies and associated vertical bearing rods permits orientation of the associated shelf even when the shelf is holding a piece of electronic equipment. Thus the associated shelf can be oriented to facilitate access for repair and maintenance and positioning during operation.

It is contemplated that multiple rack systems 10, 10' can be positioned as depicted in FIG. 3. Thus, a rack system 10, 10' can be oriented in relative proximity to a wall 100 such that the outer perimeter of support platform 31 contacts or is adjacent to the wall 100. The frame 11, 11' of rack 10, 10' can be positioned rotationally relative to the support platform 31, 31'. Where desired or required, the rack 11, 11' can be rotated to permit access to the rear or wall facing portion of the rack system 10, 10' and associated devices housed thereon. In this manner, a series of rack systems 10, 10' can be positioned proximate to one another in a manner which still facilitates access to the racks for repair and maintenance.

While the invention has been described in connection with what is presently considered to be the most practical embodiments, it is to be understood that the invention is not to be limited to the disclosed embodiments but, on the contrary, is intended to cover various modifications in equivalent arrangements. Included with the spirit and scope of the appendant claims, which scope is to be accorded the broadest interpretation so as to encompass all such modifications and equivalent structures as is permitted under the law.

What is claimed is:

1. A rack system comprising:

a rectilinear frame;

at least one shelf positioned in the rectilinear frame;

a base unit in contact with the rectilinear frame, the base unit and associated rectilinear frame rotatable around a suitable central pivot point;

a planar support base member, the planar support base member having a first upper surface and an opposed second lower surface, wherein the lower surface is configured to be in contact with a suitable support substrate and wherein the upper surface is configured to be in contact with a plurality of wheel members attached to a lower face of a horizontal support member of the base unit;

a circular bearing element defined in the upper surface of the planar support base, the circular bearing element including a ball bearing portion race and a plurality of ball bearings contained therein; and a connector for affixing a lower frame member to the pivot mechanism.

2. The rack system of claim 1 wherein the connector comprises:

an intermediate plate mounted to the circular bearing element; and a riser connected at a first end to the upper face of the intermediate plate and, at a second end, to the lower frame member.

3. The rack system of claim 1 further comprising:

means for minimizing electrical conductivity between the support substrate and the rectilinear frame included in the planar support.

4. The rack system of claim 1 wherein the plurality of wheels are in direct contact with the planar support base member and the wheels rest in one plane on the planar support base member.

5. A rack system of comprising:

a rectilinear frame, the rectilinear frame including an upper frame member, a lower frame member, and a plurality of vertical supports connected to the upper and lower frame members and extending therebetween, wherein the vertical supports are oriented essentially perpendicular to the base member;

at least one shelf positioned in the rectilinear frame;

a base unit in contact with the rectilinear frame, the base unit and associated rectilinear frame rotatable around a suitable central pivot point;

a plurality of bearing rods, the bearing rods connected to and extending between the upper frame member and the lower frame member on at least two opposed sides of the rectilinear frame, the bearing rods each having a plurality of apertures defined therein; and a plurality of vertical bearing assemblies, each vertical bearing assembly in moveable contact with an associated bearing rod and connected to a shelf.

6. The rack system of claim 5 wherein each shelf has at least two bearing assemblies attached thereto on opposed side of the shelf.

7. The rack system of claim 6 wherein the vertical bearing systems each include at least one retractable pin removably receivable in an aperture defined in the vertical bearing rod.

8. A rack system comprising:

a rectilinear frame, the rectilinear frame including an upper frame member, a lower frame member, a plurality of supports connected to the upper and lower frame member and extending therebetween;

at least one shelf positioned in the rectilinear frame;

a base unit in contact with the rectilinear frame;

a planar support base member, the planar support base member having a first upper surface and an opposed second lower surface, wherein the lower surface is configured to be in contact with a suitable support substrate, the upper surface in contact with the base unit, the base unit rotatable about a pivot point defined on the planar support base member;

a central pivot mechanism located on the planar support base member and in contact with the base unit;

a circular bearing element defined in the upper surface of the planar support base member, the circular bearing element including a ball bearing portion race and a plurality of ball bearings contained therein; and a connector for affixing a lower frame member to the central pivot mechanism.

9. A rack system comprising:

a rectilinear frame, the rectilinear frame including an upper frame member, a lower frame member, a plurality of supports connected to the upper and lower frame members and extending therebetween;

at least one shelf positioned in the rectilinear frame;

a base unit in contact with the rectilinear frame;

a planar support base member, the planar support base member having a first upper surface and an opposed second lower surface, wherein the lower surface is configured to be in contact with a suitable support substrate, the upper surface in contact with the base unit, the base unit rotatable about a pivot point defined on the planar support base member;

a plurality of bearing rods, the bearing rods connected to and extending between the upper frame member and the lower frame member on at least two opposed sides of the rectilinear frame, the bearing rods each having a plurality of apertures defined therein; and a plurality of vertical bearing assemblies, each vertical bearing assembly in moveable contact with an associated bearing rod and connected to a shelf.

* * * * *